United States Patent [19]

Wörz et al.

[11] 4,330,375

[45] May 18, 1982

[54] METHOD OF CLEANING CATHODES

[75] Inventors: Helmut Wörz; Hermann Leuprecht; Jakob Biechl, all of Brixlegg, Austria

[73] Assignee: Vereinigte Metallwerke Ranshofen-Berndorf Aktiengesellschaft, Braunau am Inn, Austria

[21] Appl. No.: 193,083

[22] Filed: Oct. 2, 1980

[30] Foreign Application Priority Data

Oct. 2, 1979 [AT] Austria ..... 6428/79

[51] Int. Cl.[3] ..... C25C 1/12; C25D 5/48

[52] U.S. Cl. ..... 204/35 R; 204/106; 204/108; 134/1

[58] Field of Search ..... 204/35 R, 106–108; 134/1

[56] References Cited

U.S. PATENT DOCUMENTS 3,701,677 10/1972 Miyata et al. ..... 204/35 R
4,103,519 8/1978 Davidson ..... 134/1

OTHER PUBLICATIONS

"The Sources of Impurities in Cathode Copper", by L. Addicks, Amer. Electrochem. Soc., Oct. 1914, pp. 1–11.
Theoretical & Applied Electrochem., by M. Thompson, Rev. Ed., 1925, p. 229.

*Primary Examiner*—R. L. Andrews
*Attorney, Agent, or Firm*—Karl F. Ross

[57] ABSTRACT

A method for the removal of impurities from copper cathodes withdrawn from a copper electrorefining bath in which the cathodes are subjected to ultrasonic vibrations in the KHz. range in heated water which is circulated or subjected to jets and under conditions in which cavitation bubbles can develop along the surfaces of the cathode.

2 Claims, 2 Drawing Figures

METHOD OF CLEANING CATHODES

FIELD OF THE INVENTION

Our present invention relates to a method cleaning cathodes, more particularly our invention deals with improvements in the electrowinning or electrorefining of copper so as to obtain a product of greater purity.

BACKGROUND OF THE INVENTION

On the electrorefining of copper, the copper in a purified state is electrodeposited upon a cathode in any electrolyte which contains generally about:

20 gams per liter of nickel ion,
4 grams per liter arsenic ion,
0.5 grams per liter antimony,
0.18 grams per liter cobalt,
0.10 grams per liter iron,
0.11 grams per liter manganese
0.17 grams per liter zinc
0.018 grams per liter lead,
0.39 grams per liter sodium,
0.012 grams per liter potassium,
0.13 grams per liter magnesium and
0.31 grams per liter calcium.

The copper content of the bath can be about 42 grams per liter while the sulphuric acid content or sulphate iron content can be about 180 grams per liter.

When copper is electrorefined in this manner, the cathodes are removed from the bath from time to time and are subjected to further processing.

Upon the removal of the cathodes from the electrolyte, electrolyte tends to adhere to the surface and, during the smelting of the cathode, a portion of the impurities which originally accrued from the electrolyte can be found in the melt and in the ingots cast therefrom. In other words, a portion of the impurities in processed copper and hence objects fabricated therefrom, can be traced to substances which were originally picked up by the cathode in electrolyte which adheres to the surface thereof.

These impurities can amount to several percent of the total impurities in the processed metal.

This has been recognized in the past and hence considerable effort has gone into developing techniques for eliminating impurities adherent to the copper. Thus, the cathodes can be subjected to an intensive washing process which can include immersing the cathode in hot water, directing jets of steam or high pressure water against the cathode and the like.

These techniques have not been found to be fully satisfactory especially where the copper surface of the cathode is not completely smooth or continuous, i.e. where the copper contains cracks, protuberances, cavities or pin holes. Consequently, while the total impurities of electrolytic copper by conventional processes can amount to 20 to 50 parts per million of which several percent can be attributed to adherent electrolyte, the conventional washing methods normally eliminate only a fraction of the latter percentage.

OBJECTS OF THE INVENTION

It is, therefore, the principal object of the present invention to provide an improved method of removing adherent impurities from copper cathodes.

Another object of the invention is to provide, in the production of copper, a method whereby the impurity level can be reduced or the purity of the copper can be increased.

SUMMARY OF THE INVENTION

These objects and others which will become apparent hereinafter are attained, in accordance with the present invention, in a method which involves removing the cathode from the electrorefining electrodeposition bath and immersing the cathode into an aqueous cleaning bath in which the cathode is subjected to ultrasonic vibration preferably in the KHz range (generally between 20 and 100 Khz) with an amplitude sufficient to enable cavitation bubbles to develop along the surfaces of the cathode.

The method of the present invention has been found to remove adherent electrolyte, sludge and scum which may adhere to the cathodes, even from the roughest surfaces, which may arise during electrorefining and practically eliminates all of the defects which have hitherto been attributed to adherent impurities.

We have found that the process is practically complete in periods as short as up to two minutes, especially when the water of the cleaning bath is caused to flow along the surfaces of the cathode and most advantageously upwardly from an inlet on the bottom of the washing tank, the water being carried away from the top of the bath within the tank.

The water inlet at the bottom of the tank may include means for injecting the water in the form of jets and, most advantageously, the water in the bath is heated preferably to a temperature close to the boiling point, e.g. between 90° and 100°.

The water used is preferably degassed prior to introduction into the bath e.g. by boiling or permitting the water to stand for a period of hours.

When the cathodes are removed from the hot water bath, the film of water thereon rapidly evaporates and the dry cathode can be transferred to the smelting chamber.

Investigations have shown that the surface of the cathode is free from adherent electrolyte or other surface impurities and that the smelted product has significantly less sulphur. Water soluble residual sulphur in the cathode is less than 1 part per million.

BRIEF DESCRIPTION OF THE DRAWING

The above and other objects, features and advantages of the present invention will become more rapidly apparent from the following description, reference being made to the accompanying drawing in which.

SPECIFIC DESCRIPTION

Figure 1:
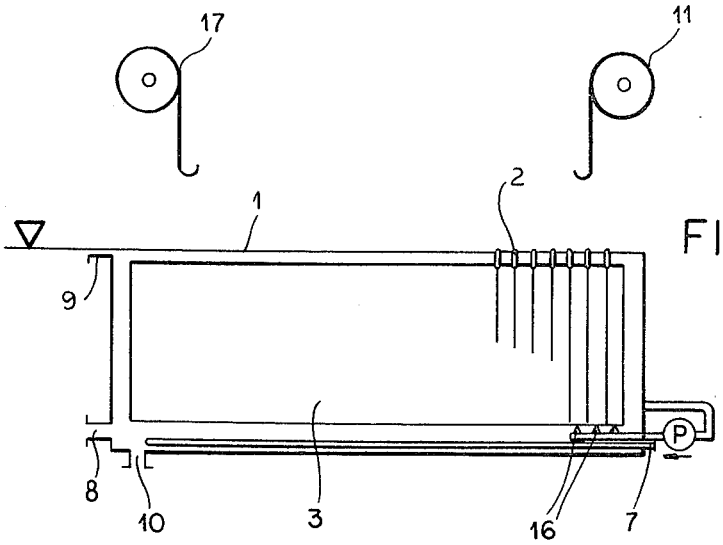
FIG. 1 is a vertical section diagrammatically illustrating a tank for carrying out the method of the present invention.
Figure 2:
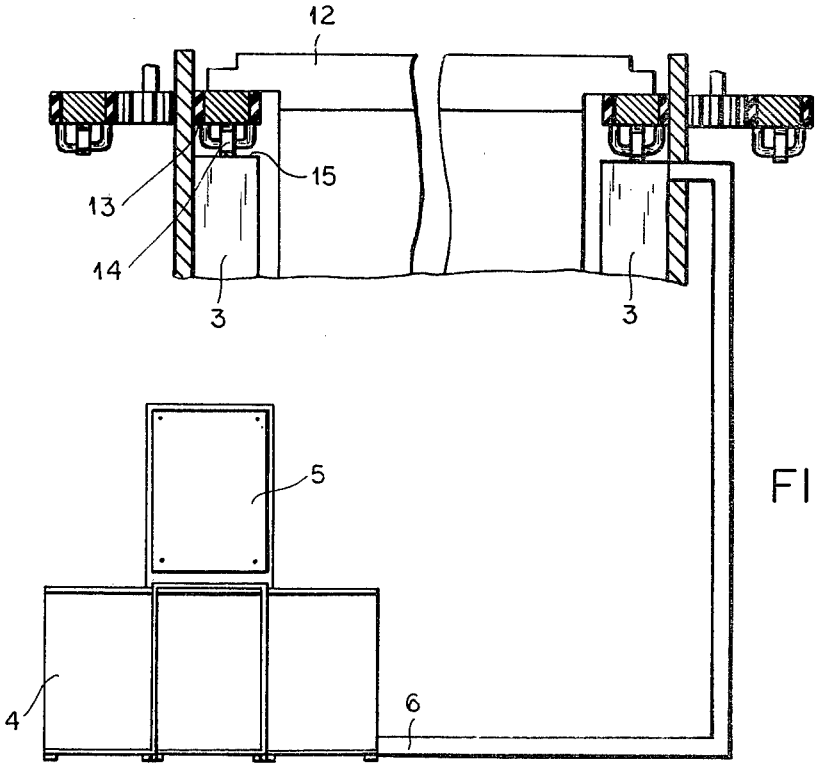
FIG. 2 is a transverse section thereof, the high frequency source for the ultrasonic transducers being represented only diagrammatically.

The cathodes removed from the electrolytic cell are inserted into the washing tank 1 by a crane 11 which lowers the cathodes 2 with their supports 12 onto chains 13 which ride on rollers 14 along ledges 15 formed by a pair of ultrasonic transducers 3 immersed in the tank and fixed along the longitudinal sides thereof.

A heating coil 7, which may be supplied with superheated steam or may be an electrical heating coil, is provided along the bottom of the tank 1 directly below the cathodes 2, the tank 1 being filled with heated and degassed water, which is additionally heated by the coil 7.

Ultrasonic transducers 3 are connected by a high frequency cable 6 to a high frequency alternating current generator 4 whose electrical cabin 5 connects the generator with the usual power supply network.

The overflow 9 carries away impurities and water rising along the surfaces of the cathodes, additional water being fed at inlet 8 and via nozzles 16 in jets directed upwardly along the surfaces of the cathodes. Periodically, settled solids may be discharged through the outlet 10.

In operation, the crane 11 lowers each cathode into the bath. The cathodes are carried therealong by the chains 13 and are ultimately removed by a crane 17, the ultrasonic vibration being transmitted by the transducers 3 directly to the cathodes through the supports 12 and to the liquid in contact with the cathodes 2 thereby producing cavitation bubbles along the vertical surfaces of the cathodes.

We claim:

1. A method of cleaning the surfaces of a copper cathode removed from an electrorefining bath comprising the steps of:

(a) supporting said cathode on an ultrasonic transducer immersed in a cleaning bath of heated degassed water with said surfaces of said cathode in contact therewith;

(b) subjecting said cathode in contact with said transducer to direct ultrasonic vibrations therefrom; and (c) subjecting said surfaces of said cathode immersed in said cleaning bath to ultrasonic vibrations therefrom transmitted through said cleaning bath.

2. The method definded in claim 1 wherein in steps b and c said cathode is subjected to ultrasonic vibrations at a frequency of about 20 to about 100 KHz for a period of up to two minutes to form cavitation bubbles along the surfaces thereof while directing jets of water upwardly along the surfaces of said cathode.

* * * * *